United States Patent [19]

Berges et al.

[11] Patent Number: 5,049,050

[45] Date of Patent: Sep. 17, 1991

[54] METHOD FOR OPERATING A TWIN SHAFT VACUUM PUMP ACCORDING TO THE NORTHEY PRINCIPLE AND A TWIN SHAFT VACUUM PUMP SUITABLE FOR THE IMPLEMENTATION OF THE METHOD

[75] Inventors: Hanns-Peter Berges, Cologne; Wolfgang Leier, Bergisch-Gladbach, both of Fed. Rep. of Germany

[73] Assignee: Leybold Aktiengesellschaft, Fed. Rep. of Germany

[21] Appl. No.: 482,151

[22] Filed: Feb. 20, 1990

[51] Int. Cl.[5] ..... F04C 29/00; F04C 23/00

[52] U.S. Cl. ..... 418/97; 418/9; 418/206

[58] Field of Search ..... 418/9, 15, 97, 200, 418/205, 206

[56] References Cited

FOREIGN PATENT DOCUMENTS

| | | | |
|---|---|---|---|
| 1915269 | 10/1970 | Fed. Rep. of Germany | 418/15 |
| 62-157289 | 7/1987 | Japan | 418/15 |
| 2111126 | 6/1983 | United Kingdom | 418/200 |

*Primary Examiner*—Leonard E. Smith
*Assistant Examiner*—David L. Cavanaugh
*Attorney, Agent, or Firm*—Hill, Van Santen, Steadman & Simpson

[57] ABSTRACT

The invention is directed to a method for the operation of a twin shaft vacuum pump (1) having two rotors (4, 5; 6, 7; 8, 9) that rotate synchronously and in non-contacting fashion in a pump chamber, each being provided with a respective projection (38) and a recess (39), the one of said rotors controlling an admission opening (32, 35) and the other controlling a discharge opening (33, 37, 42); the invention is also directed to a twin shaft vacuum pump suitable for the implementation of the method; in order to be able to admit flushing gas into a twin shaft vacuum of this species during operation as well, it is proposed that flushing gas be admitted into the respectively diminishing pump volume via an orifice (45) that is controlled such by the rotor at the discharge side that the respective pump volume is closed both toward the admission opening (35) as well as toward the discharge opening (42) at the moment the flushing gas is supplied.

6 Claims, 2 Drawing Sheets

METHOD FOR OPERATING A TWIN SHAFT VACUUM PUMP ACCORDING TO THE NORTHEY PRINCIPLE AND A TWIN SHAFT VACUUM PUMP SUITABLE FOR THE IMPLEMENTATION OF THE METHOD

TECHNICAL FIELD

The invention is directed to a method for operating a twin shaft vacuum pump. The invention is also directed to a twin shaft vacuum pump suitable for the implementation of this operating method.

BACKGROUND OF THE INVENTION

EU-A 87107089 discloses a twin shaft vacuum pump of this species. The rotors are each respectively equipped with a projection (claw tooth) and with a recess and execute their rotational motion in meshing and non-contacting fashion in the pump chamber. The respective recesses control the admission and discharge openings situated in the lateral shields of the pump chamber. During the synchronous motion of the rotors, pump volumes that are sealed by gap openings and initially enlarge and then again diminish are formed, these pump volumes compressing the gas in-flowing at the suction side and conveying it to the delivery side.

SUMMARY OF THE INVENTION

The object of the present invention is to specify an operating method for a twin shaft vacuum pump according to the Northey principle and to fashion a twin shaft vacuum pump of this species such that it can be flushed with a gas during operation as well without the gas flushing having a critical negative influence on the pump properties (ultimate pressure, displacement capacity, etc.). This object is inventively achieved by the method and apparatus of the present invention. In a twin shaft vacuum pump operated in this fashion or, respectively, designed in this fashion, flushing gas can be admitted into the pump volume respectively conveyed to the discharge without having this admission of flushing gas deteriorate the ultimate pressure or the displacement capacity of the pump. Dust-like particles that would otherwise settle on the pistons or at the walls of the pump chamber are held in suspension and are conveyed out with the assistance of the flushing gas. An admission for flushing gas is especially advantageous when reactive gases (for example, $CCl_4$, $BCl_3$, HCl, $O_2$ or the like) are conveyed with the assistance of the pump. The reactivity of the gases can be reduced to a considerable degree with the assistance of the flushing gas. The pump properties are not deteriorated in that the flushing gas is always admitted into the pump volume only when the admission opening is already closed and the discharge opening is not yet opened.

Further advantages and details of the invention shall be set forth with reference to the exemplary embodiments.

DETAILED DESCRIPTION OF THE PREFERRED EMBODIMENTS

Figure 1:
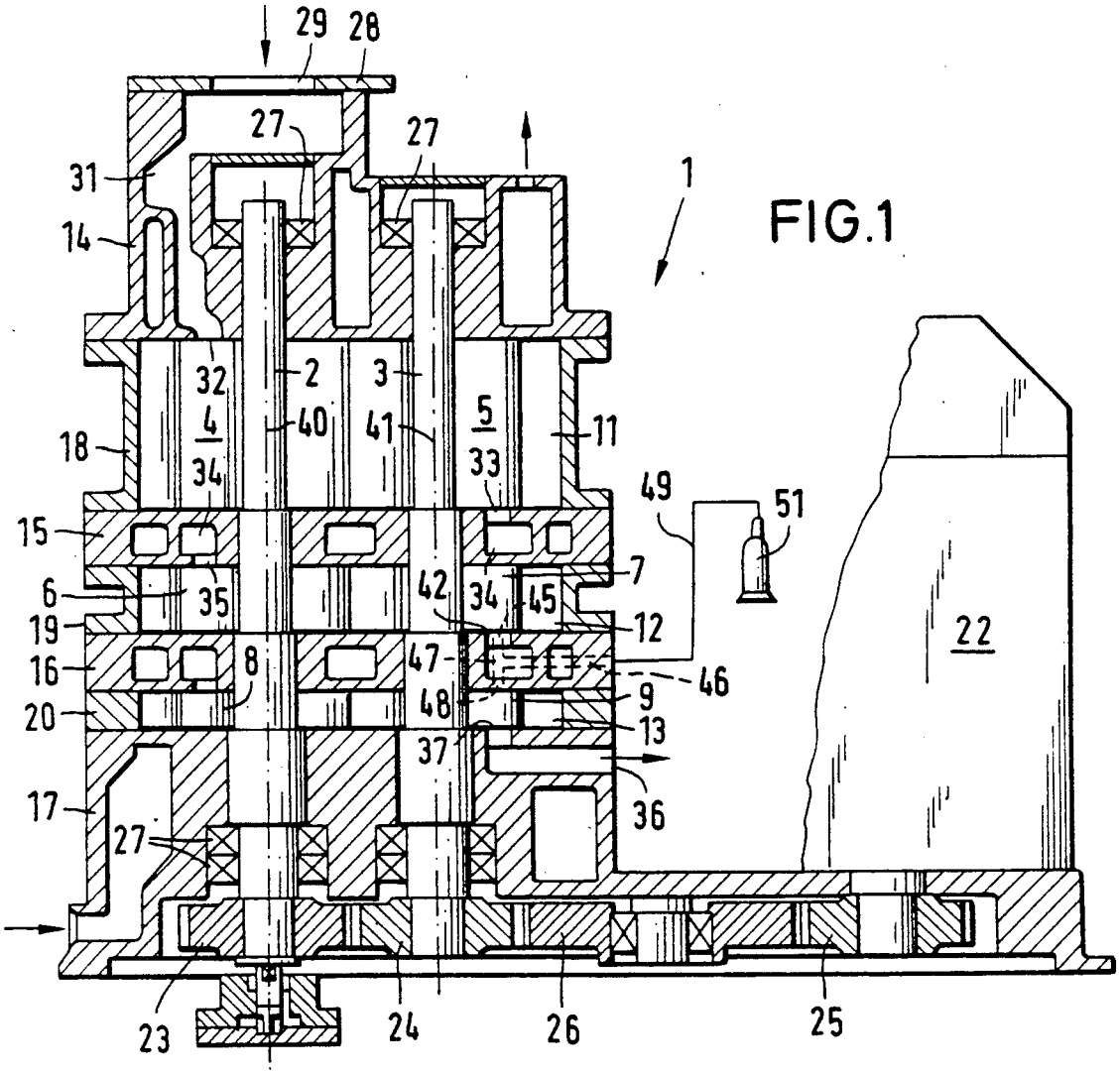
FIG. 1 a longitudinal section through a multi-stage pump of the invention.

The exemplary embodiment shown in FIG. 1 is a three-stage vacuum pump 1 having two shafts 2 and 3 as well as three rotor pairs 4, 5 or, respectively, 6, 7 or, respectively, 8, 9. The axial length of the rotors decreases from the suction side to the delivery side. The rotary pistons are of the claw type (see FIG. 2) and rotate in the pump chambers 11, 12, 13 that include pump walls that are formed by the shields 14–17 and by the housing rings 18–20.

The drive motor 22 is situated next to the vertically arranged pump housing. The shafts 2, 3 are equipped below the lower end shield 17 with gear wheels 23, 24 of identical diameter that serve for the synchronization of the motion of the rotor pairs 4, 5 and, respectively, 6, 7 and, respectively, 8, 9. The drive motor 22 also comprises a gear wheel 25 at its underside. The drive connection is produced by a further gear wheel 26 that is in engagement with the gear wheels 24 and 25.

The shafts 2, 3 are supported in the upper end shield 14 and the lower end shield 17 via rolling bearings 27. The upper end shield 14 is equipped with a horizontally arranged connecting flange 28 that forms the admission 29 of the pump. At its end face (opening 32), the admission channel 31 discharges into the pump chamber 11 in the first stage. The discharge opening of the first stage arranged at the end face is referenced 33 and leads into the connecting channel 34. The connecting channel 34 situated in the shield 15 is in communication with the admission opening 35 of the second stage. The end shield 16 is correspondingly fashioned. The discharge 36 is situated under the lowest (third) pump stage, this discharge 36 being in communication with the end-face discharge opening 37 in the lower end shield 17.

Figure 2:
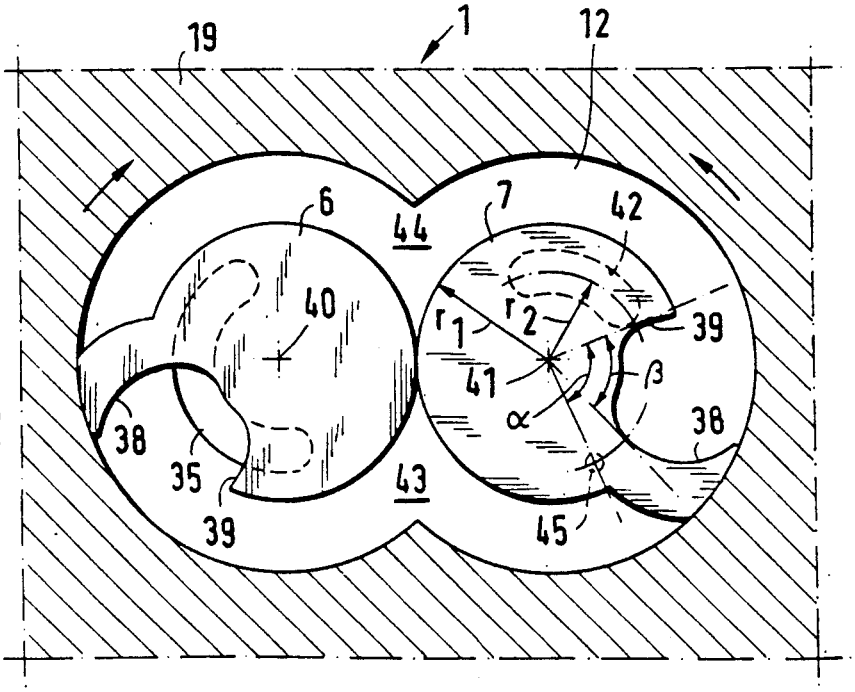
FIGS. 2–4 sections at the level of the middle rotor pair.

It may be seen with reference to FIG. 2 that each of the rotors is provided with a projection 38 and with a recess 39. For the rest, they have the shape of a circular disk having the radius $r_1$. They rotate meshing and in non-contacting fashion around the axes 40 and 41 in their respective pump chambers 11, 12, 13.

The control of admission and discharge ensues with the recesses 39. The admission opening 35 is allocated to the rotor 6 at the admission side and the discharge opening 42 is allocated to the rotor 7 at the discharge side. The two rotors always form two spaces (pump volumes) 43, 44 whereof the enlarging space 43 is connected to the admission opening 35. The space 44 that diminishes as a consequence of the rotor rotation is connected to the discharge opening 42.

In the invention, the orifice 45 of a flushing gas line is situated in the pump chamber 12. It is indicated in FIG. 1 that a part of the flushing gas line is formed by a longitudinal bore 46 and by a transverse bore 47 in the lateral shield 16. The transverse bore 47 leads to orifices 45, 48 placed in the pump chambers 12, 13, so that both stages at the discharge side of the multi-stage twin shaft vacuum pump 1 can be supplied with flushing gas. Via a line 49 conducted outside the pump 1, the bore 46 is in communication with a flushing gas reservoir 51, for example, a nitrogen bracket.

Figure 3:
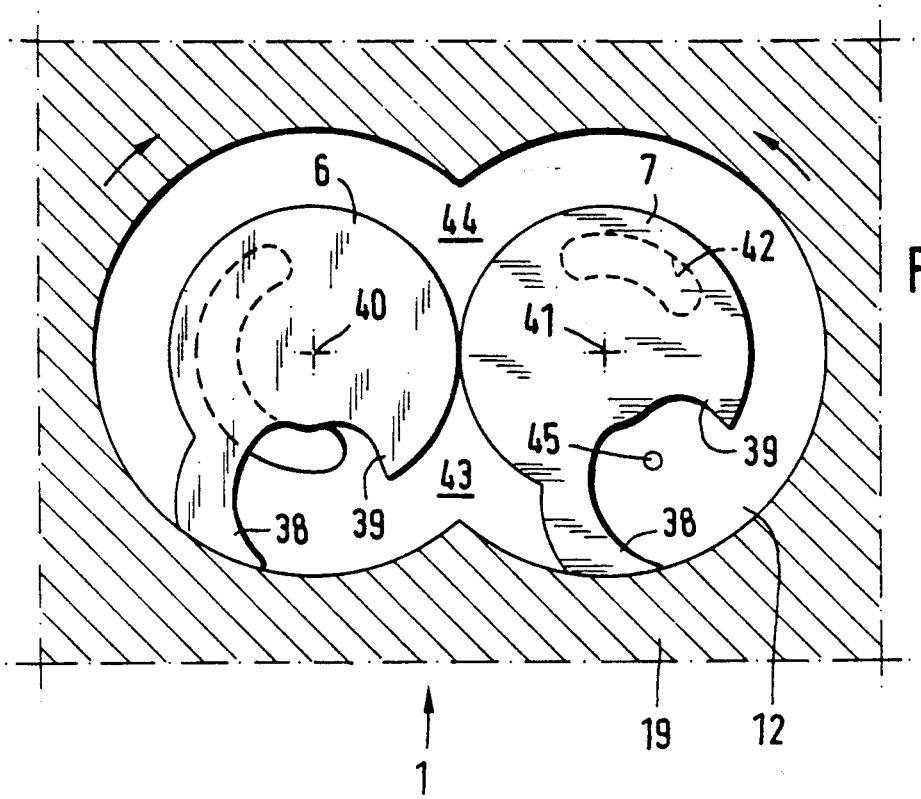
Figure 4:
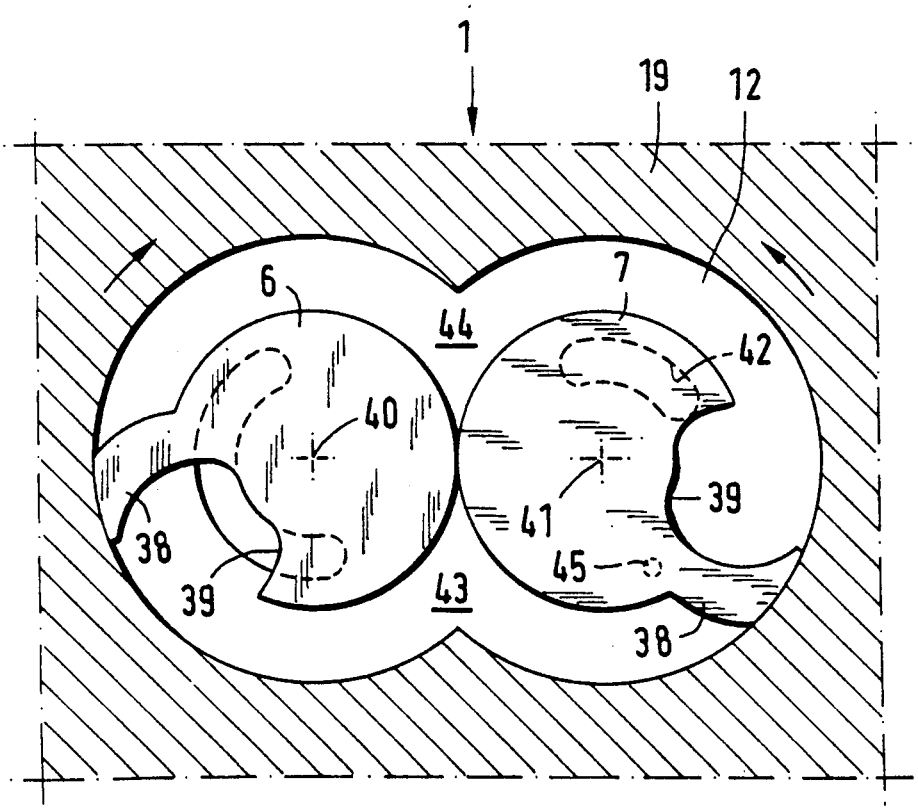

FIGS. 2–4 show the exact position of the orifice 45 in the pump chamber 12. It is allocated to the rotor 7 of the discharge side and lies on a circle around the axis 41 having the radius $r_2$ on which the discharge opening 42 also lies. As a result thereof, it is also possible to control the delivery of flushing gas with the recess 39 in the rotor 7. Moreover, the position of the orifice 45 is selected such that the respective pump volume is closed both toward the admission opening as well as toward the discharge opening at the moment the flushing gas is supplied (FIG. 3). This condition is met when the orifice 45 of the flushing gas line precedes the discharge opening 42—with reference to the rotary motion of the rotor 7. So that there is never a short between the discharge opening 42 and the orifice 45 of the flushing gas line at any time, the angle o that is defined by the position of the flushing gas orifice 45 and the beginning of the discharge opening 42 must be greater than the angle $\beta$ that is defined by the width of the recess 39 in the rotor 7. The maximum size of the angle $\alpha$ is established by the necessary condition that a short between the admission 35 and the flushing gas orifice 45 may never exist at any time.

We claim:

1. A twin-shaft vacuum pump comprising the following:

first and second non-contacting rotors synchronously rotating about first and second axes inside a pump chamber;

said first rotor including a projection and a recess and means for opening and closing an intake opening in a first lateral shield defining a first wall of said pump chamber, said intake opening and said recess of said first rotor being spaced a similar distance from said first rotational axis;

said second rotor including a projection and a recess and means for opening and closing a discharge opening in a second lateral shield defining a second wall of said pump chamber, said discharge opening and said recess of said second rotor being spaced a similar distance from said second rotational axis;

a flushing gas line terminating in a flushing gas inlet port opening into said pump chamber adjacent said second rotor, said gas inlet port and said recess of said second rotor being disposed generally along a circle centered on said second rotational axis said discharge opening includes an outermost edge closest to said gas inlet port, said outermost edge and said gas inlet port defining an angle alpha having sides converging at said second rotational axis;

said recess in said second rotor has a width defining an angle beta having sides converging at said second rotational axis; and said angle alpha is greater than angle beta.

2. A vacuum pump according to claim 1, wherein said first and second rotors are rotationally offset such that said intake and discharge openings are closed when said flushing gas inlet port is open.

3. A twin-shaft, multi-stage vacuum pump, each stage of said pump comprising the following:

first and second non-contacting rotors synchronously rotating about first and second axes inside a pump chamber;

said first rotor including a projection and a recess and being adapted and constructed to open and close an intake opening in a first wall of said pump chamber, said intake opening and said recess of said first rotor being spaced a similar distance from said first rotational axis;

said second rotor including a projection and a recess and being adapted and constructed to open and close a discharge opening in a second wall of said pump chamber, said discharge opening and said recess of said second rotor being spaced a similar distance from said second rotational axis;

a flushing gas line terminating in a flushing gas inlet port opening into said pump chamber adjacent said second rotor, said gas inlet port and said recess of said second rotor being spaced a similar distance from said second rotational axis.

4. A twin-shaft, multi-stage vacuum pump according to claim 3, wherein said pump comprises three stages.

5. A twin-shaft, multi-stage vacuum pump according to claim 3, wherein said first and second walls of said pump chamber extend generally perpendicular to said rotational axes.

6. A method of operating a twin-shaft vacuum pump having first and second non-contacting rotors synchronously rotating inside a pump chamber, said rotors including operatively interactive projections and recesses, said first rotor including means for opening and closing an intake opening, and said second rotor including means for opening and closing a discharge opening, said method comprising the following steps:

sequentially closing said intake opening, admitting flushing gas into said pump chamber, and opening said discharge opening; and controlling the admission of said flushing gas with said second rotor;

wherein said recess in said second rotor, said discharge opening, and said gas inlet port are disposed generally along a circle centered on said second rotational axis said discharge opening includes an outermost edge closest to said gas inlet port, said outermost edge and said gas inlet port defining an angle alpha having sides converging at said second rotational axis;

said recess in said second rotor has a width defining an angle beta having sides converging at said second rotational axis; and said angle alpha is greater than angle beta.

* * * * *